US008990968B2

(12) United States Patent
Garegnani

(10) Patent No.: US 8,990,968 B2
(45) Date of Patent: Mar. 31, 2015

(54) NURSING COVER

(76) Inventor: Patricia Garegnani, San Diego, CA (US)

( * ) Notice: Subject to any disclaimer, the term of this patent is extended or adjusted under 35 U.S.C. 154(b) by 0 days.

(21) Appl. No.: 13/426,459

(22) Filed: Mar. 21, 2012

(65) Prior Publication Data

US 2012/0240306 A1 Sep. 27, 2012

Related U.S. Application Data

(60) Provisional application No. 61/466,441, filed on Mar. 22, 2011.

(51) Int. Cl.
*A41D 1/20* (2006.01)

(52) U.S. Cl.
CPC ..... *A41D 1/205* (2013.01)
USPC ..... 2/104; 2/46; 2/50

(58) Field of Classification Search
CPC ... A41D 1/205; A41D 15/04; A41D 2300/20; A41D 13/1245; A41D 2400/38; A41D 2400/42; A41D 2400/482; A41D 27/20; A41D 32/08; A41D 10/00; A41D 13/0051; A41D 13/04; A41D 13/1236; A41D 13/129; A41D 15/00
USPC ..... 2/104, 455, 46, 48, 49, 49.1, 49.4
See application file for complete search history.

(56) References Cited

U.S. PATENT DOCUMENTS

| | | | | |
|---|---|---|---|---|
| 4,106,122 | A * | 8/1978 | Dodd | 2/104 |
| 4,631,754 | A * | 12/1986 | Ryan | 2/104 |
| 4,989,268 | A * | 2/1991 | Stolhand | 2/104 |
| 5,038,411 | A | 8/1991 | St. Armand | |
| 5,090,059 | A * | 2/1992 | Kahl | 2/104 |
| D359,838 | S * | 7/1995 | Laseinde | D2/864 |
| 5,469,582 | A | 11/1995 | Livingston | |
| 5,544,364 | A * | 8/1996 | Weber | 2/104 |
| 6,216,273 | B1 * | 4/2001 | Williams | 2/104 |
| 6,216,274 | B1 * | 4/2001 | Harris | 2/104 |
| 6,877,167 | B2 * | 4/2005 | Korkor | 2/45 |
| 7,406,718 | B2 * | 8/2008 | Ekelund et al. | 2/104 |
| 7,409,727 | B2 * | 8/2008 | Ekelund et al. | 2/104 |
| 7,490,362 | B2 | 2/2009 | Owen | |
| D591,483 | S | 5/2009 | Petti | |
| 7,555,790 | B2 * | 7/2009 | Ostrander | 2/104 |
| 7,640,600 | B2 | 1/2010 | Reder | |
| 8,091,145 | B2 | 1/2012 | Ekelund | |
| 8,151,372 | B2 * | 4/2012 | Densmore et al. | 2/104 |
| 8,191,173 | B2 | 6/2012 | Ekelund | |
| 8,196,222 | B2 | 6/2012 | Ekelund | |
| 2007/0151000 | A1 | 7/2007 | Gates | |
| 2008/0201817 | A1 * | 8/2008 | Ostrander | 2/52 |
| 2010/0088800 | A1 | 4/2010 | Pate-Gurule | |
| 2010/0281598 | A1 * | 11/2010 | Densmore et al. | 2/104 |
| 2012/0151657 | A1 | 6/2012 | Gibbons | |
| 2012/0185993 | A1 | 7/2012 | Cohen | |

* cited by examiner

*Primary Examiner* — Alissa L Hoey
*Assistant Examiner* — Catherine M Ferreira
(74) *Attorney, Agent, or Firm* — Lewis Kohn & Walker LLP; Kent Walker; Kari Moyer-Henry

(57) ABSTRACT

A method and system for covering from public view a nursing mother's breast and child while breast feeding, the system comprising of a particular arrangement of a decorative cover that fits around the front and neck of a mother and over the baby and includes a device that lifts the cover to provide space for the mother to breast feed the baby while maintaining coverage from public view.

10 Claims, 11 Drawing Sheets

NURSING COVER

The present application claims the benefit and priority of and incorporates by this reference U.S. Provisional Application No. 61/466,441 filed with the United States Patent and Trademark Office on Mar. 22, 2011.

FIELD OF THE INVENTION

The present invention relates generally to nursing covers for covering a mother and baby while the baby nurses. More specifically, the present invention is directed to a particular arrangement of a decorative cover that fits around the front and neck of a mother and over the baby and includes a device that lifts the cover to provide space for the mother to breast feed the baby while maintaining coverage from public view.

BACKGROUND OF THE INVENTION

The statements in this section merely provide background information related to the present disclosure and may not constitute prior art.

Nursing can be intimidating to a new mom for fear of accidently exposing herself. Having suitable nursing cover products may have an impact on a woman's choice of whether and when to breastfeed. Moms are generally always looking for products that can help make their life a bit easier. Various nursing covers have been used by mothers tending to their babies. These normally comprise some form of cover over the front of the mother and over the baby. However, they are often difficult to wear and to use. For example, they do not fit properly so that they tend to slip or fall off and they are not flattering. They tend to have insufficient space for the mother to see the baby while feeding. The present invention addresses these and other deficiencies.

SUMMARY OF THE INVENTION

In order to solve these and other needs in the art, the inventor hereof has succeeded in designing a nursing cover that in one exemplary embodiment includes a collar for viewing, a cover or shawl integrated with the collar, a flap for viewing integrated with the cover, pleated fabric in the front, side panels that wrap around the torso, attachments to secure the cover around the torso, an on/off latch system, weighted decorative trim, and other helpful features that aid in giving more confidence to a mother that chooses to breast feed her baby, especially in public.

In another exemplary embodiment the nursing cover includes a shawl having a neck opening and a flap by the neck opening. At least two straps are connected to the shawl by the neck opening to secure the cover to the neck of the nursing mother. The invention further includes a collar connected to the shawl by the neck opening and flap and also connected to the straps. The collar includes legs, sides and a bill. The legs extend the collar in a first direction, and the sides and bill accordingly extend the shawl in the first direction to form a pocket under the collar and shawl. The baby rests within this pocket. The shawl further includes front pleats by the neck opening, flap and collar, to provide additional spaces between the shawl and collar. The flap opens and closes to expose space between the legs, sides and bill through which the nursing mother can look at the baby. The shawl further includes side panels and fasteners at ends of the side panels that secure the ends to each other, and a weighted trim attached to the shawl to keep the ends of the shawl down. The sides of the shawl are sufficiently wide so that the shawl wraps around the torso of the mother and tucks under the legs of the mother. This provides additional security and privacy.

Further areas of applicability of the present invention will become apparent from the detailed description provided hereinafter. It should be understood that the detailed description and specific examples below, while indicating exemplary embodiments of the invention, are intended for purposes of illustration only and are not intended to limit the scope of the invention.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
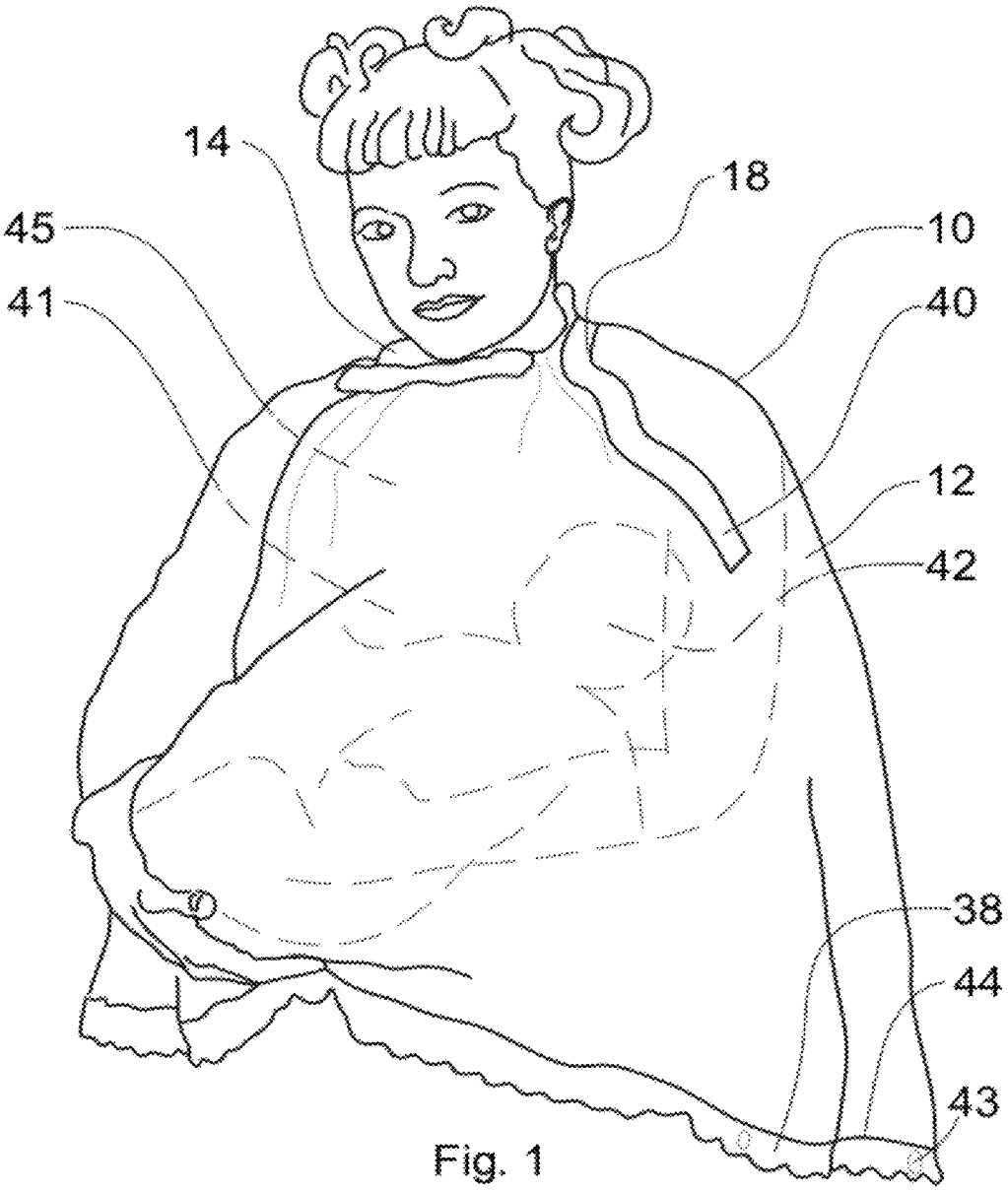
FIG. 1 is a perspective view of the present invention.

The following description of various embodiments is merely exemplary in nature and is in no way intended to limit the invention, its applications, or uses. Throughout the drawings, corresponding reference numerals indicate like or corresponding parts and features.

Figure 2:
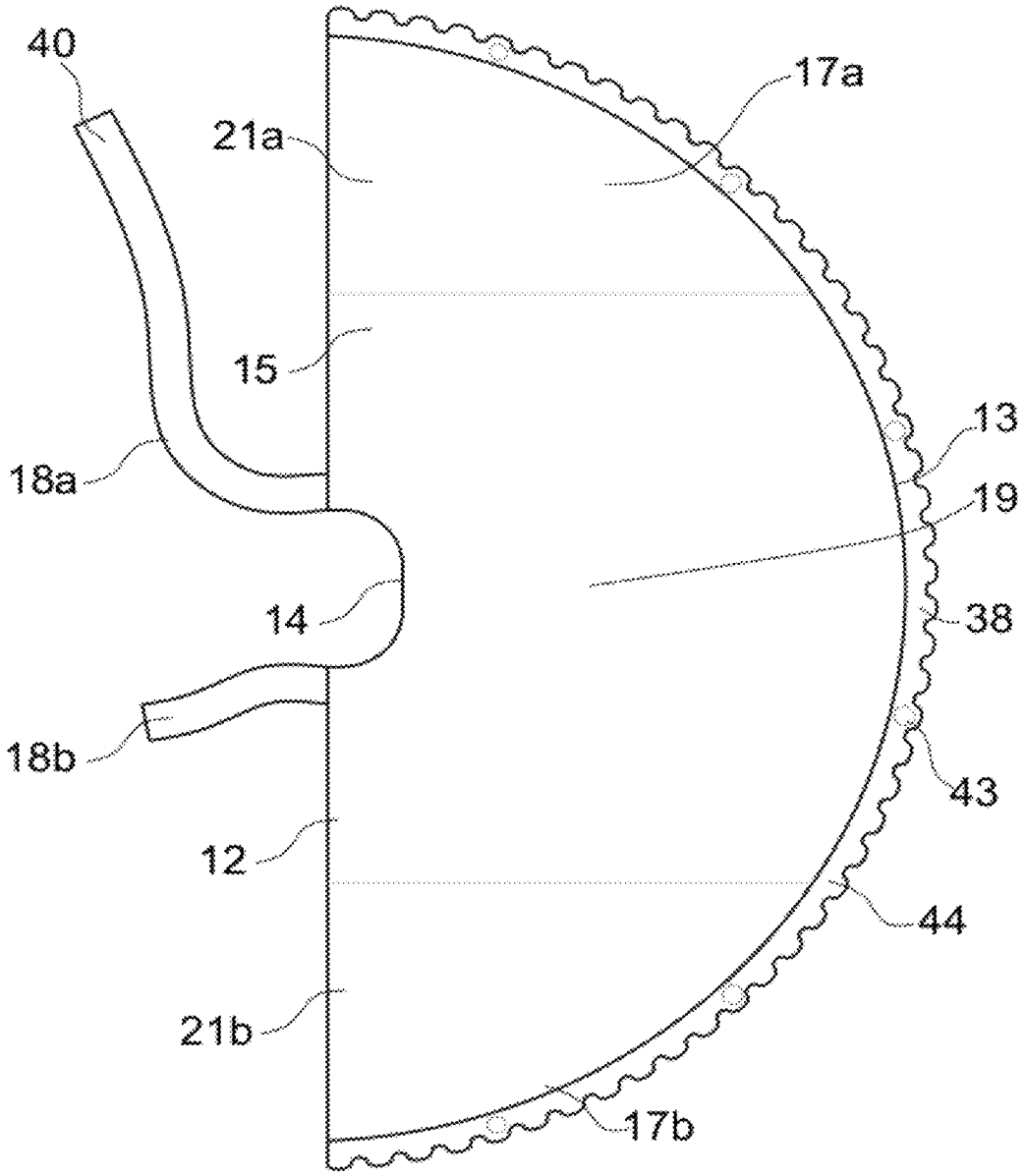
FIG. 2 is a front view of material for the present invention.

Referring to FIG. 1, there is shown a nursing cover, generally indicated by reference number 10, according to one embodiment of the present invention. As shown in FIG. 1 and FIG. 2, the nursing cover 10 includes a shawl 12. The shawl 12 is preferably made of lightweight material, such as fabric including silk or nylon blend, but can also be made of plastic materials and other flexible, lightweight materials suitable for garments. Such materials are preferably washable and wrinkle-free. The material may come in a variety of patterns that are fun and stylish. For privacy purposes, the material is preferably not transparent or otherwise see-through material.

As shown in FIGS. 1 and 2, substantial yardage of material is preferably used for the shawl 12. Enough material is used to cover the nursing mother's torso in front and in back. For example, the shawl preferably includes between 10 to 20 square feet of material, but may include less or more material depending on the size. Accordingly, in use, the shawl 12 wraps around the mother's body. The shawl 12 preferably wraps over the shoulder of the mother on the side where she holds the head of the baby 42. The shawl 12 fits over or under the mother's other shoulder depending on how she wants to place and use her other hand (e.g., see also FIG. 7).

The nursing cover 10 includes straps 18 attached to the shawl 12 proximate the neck opening 14 to secure the shawl 12 and nursing cover 10 around the mother's neck. As shown in FIGS. 1 and 2, the straps 18 are preferably of different lengths (e.g., 18*a*, 18*b*). That is, one strap 18*a* is longer than the other strap 18*b* to provide a handle 40 based on its extra length to facilitate fastening the straps 18 together to put the nursing cover 10 on and unfastening the straps 18 to take it off.

As shown in FIG. 2, the overall shape of the shawl 12 is preferably semi-circular. Accordingly, it includes a curved side 13 and a straight side 15. The shawl 12 also includes a neck opening 14 near the center of the straight side 15. The shawl 12 preferably comprises three panels or sections, including two side panels 17 and a center panel 19. Side panels 17*a*, 17*b* have ends 21*a*, 21*b*, where, as described further, Suitable Fasteners are included to fasten the ends 21*a*, 21*b* together to secure the shawl 12 and cover 10 around the mother's torso (e.g., the term "Suitable Fasteners" includes without limitation, Velcro (Velcro strips that fasten and unfasten to each other or to other material), buttons (i.e., buttons and holes), snaps (e.g., male and female snap components that fasten together to close, usually by applying pressure, and unfasten to open, similar to those used on pajamas, nightshirts, for example), clips (e.g., male and female clips that fasten together and unfasten; clips with closing mechanisms such as springs, levers; bent metal to fasten on material or another clip, which can also be unfastened; safety clips; safety pins), hooks (e.g., male and female hook components that fasten together and unfasten, hooks that fasten to other components with holes or other openings and unfasten), magnets (e.g., pairs of magnets, magnets that fasten by attraction to metal or other magnetic material), stitching (e.g., stitched seams, threated seams, sewn seams), zippers, tape and adhesives; and the term "Suitable Fasteners" is used herein to describe various fasteners and connections of components of the invention). The shawl 12 can be formed in different shapes, such as semi-oblong, semi-elliptical, triangular, square, and rectangular. The shawl 12 can also be formed in multiple sizes, e.g., large, medium and small, by varying the amount of material used. Multiple shawls 12 can be made and then used interchangeably (e.g., by connecting a selected shawl 12 to the straps 18 and/or casing 30 of the collar 20 as described further below).

As shown in FIGS. 1 and 2, the two side panels 17*a*, 17*b* connect to the center panel 19 of the shawl 12. Side panels 17*a*, 17*b* may comprise separate panels connected to center panel 19 or the same continuous material as the center panel 19. Side panels 17*a*, 17*b* may be connected to the center panel 19 by sewing the panels together or by other Suitable Fasteners. The side panels 17*a*, 17*b* add material and width to the sides of the shawl 12 to cover the nursing mother. This is helpful, for example, if the baby moves around or if the wind is blowing. By further example, the two side panels 17*a*, 17*b* are long enough to tuck under the mother's legs while she is in a seated position and keep the cover 10 in place without the use of the mother's hands. For example, FIG. 8 shows an embodiment where the mother can sit on the side panels 17*a*, 17*b* and/or center panel 19 tucked under the mother's legs or seat, at least in part.

Figure 3:
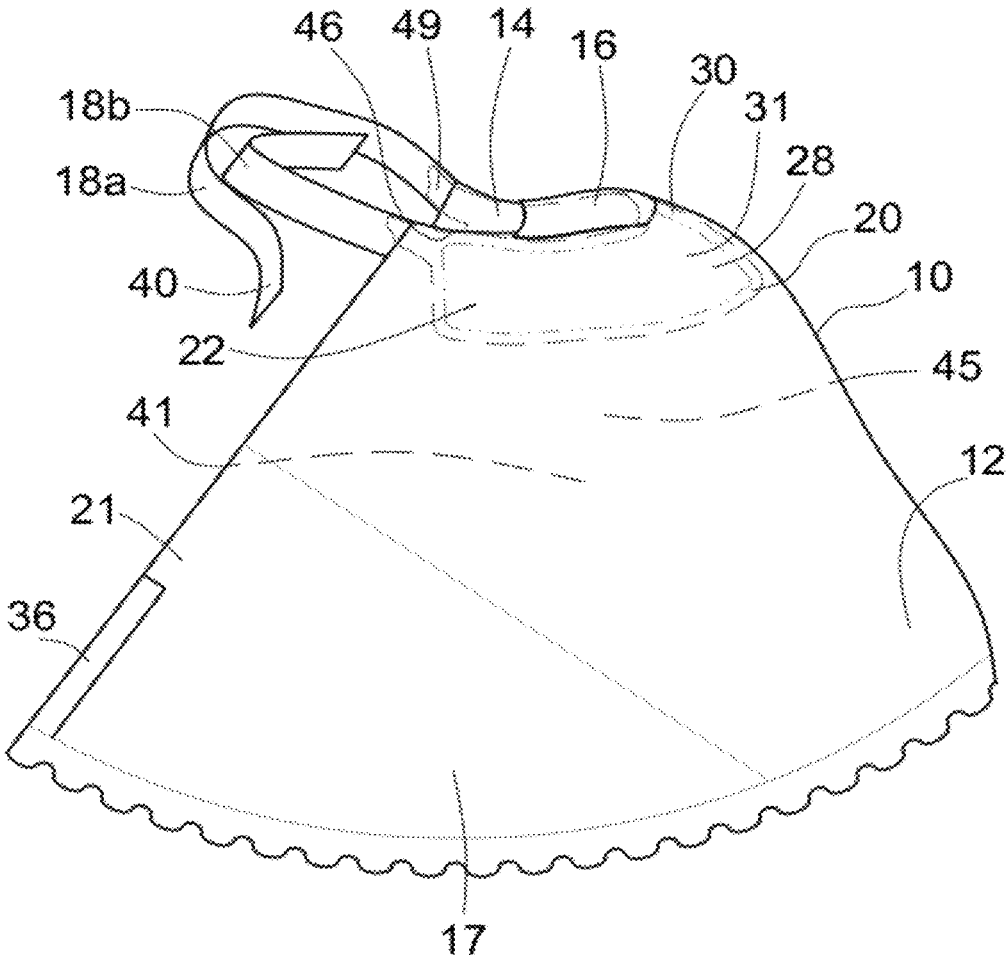
FIG. 3 is a side view of the present invention.
Figure 8:
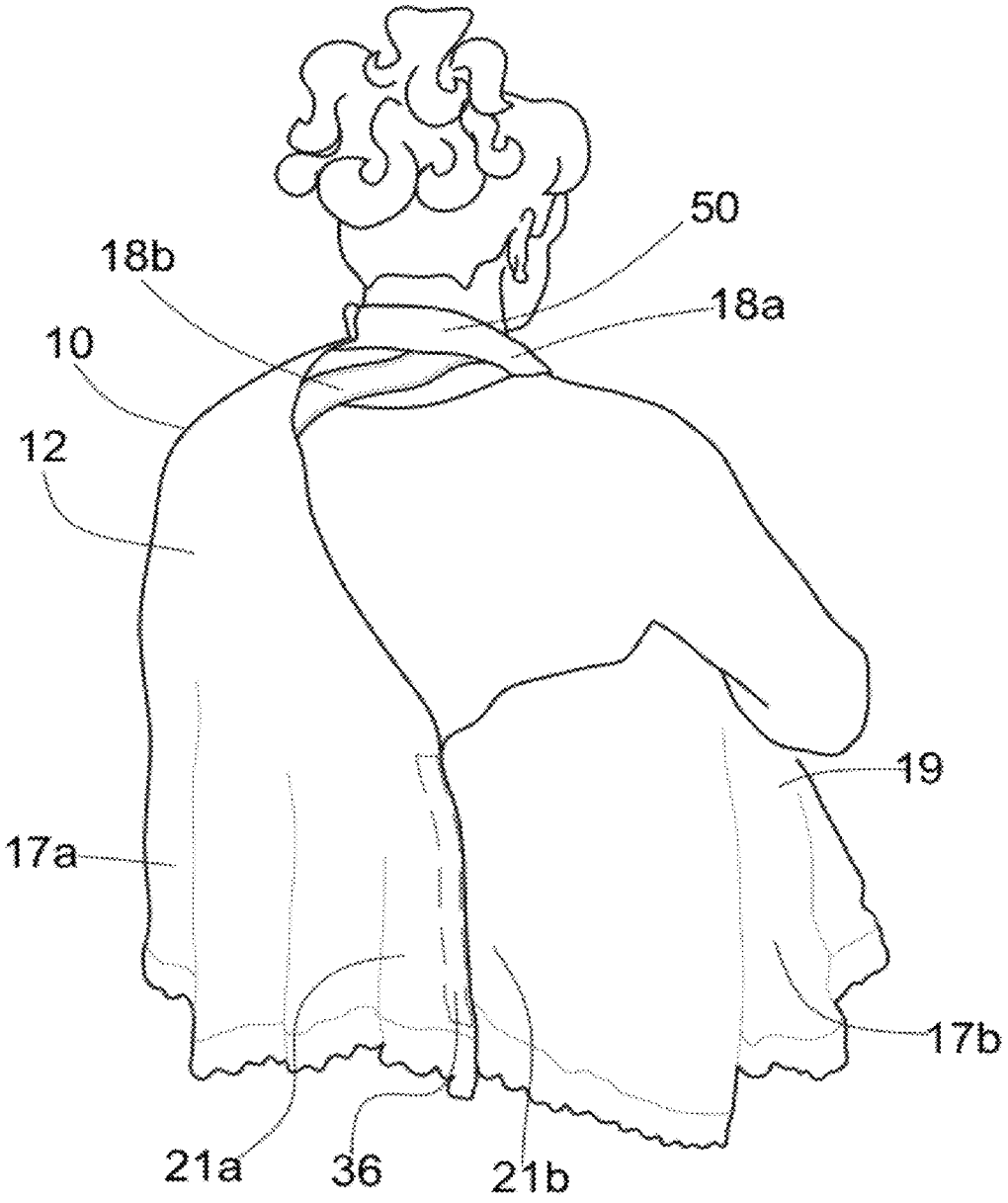
FIG. 8 is a rear view of the present invention.

As further shown in FIGS. 3 and 8, for the security and proper coverage in the standing or sitting position, the ends 21*a*, 21*b* of the side panels 21*a*, 21*b* include fasteners 36. As noted above, these fasteners 36 include any Suitable Fasteners, including but not limited to Velcro. This allows the mother to attach the nursing cover 10 around the bottom portion of her torso and keep the nursing cover 10 securely in place, so she can use both hands to hold her baby. She does not have to worry about holding the material of the shawl 12 of the nursing cover 10 down.

Figure 9:
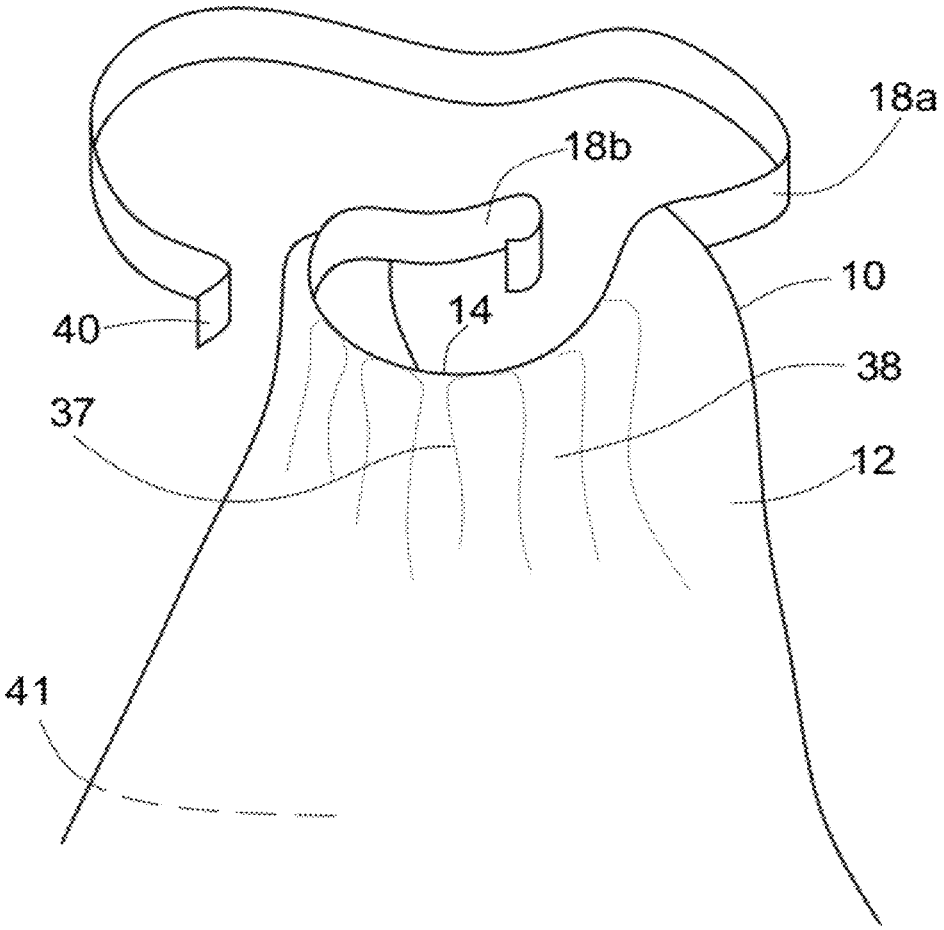
FIG. 9 is a perspective view of the present invention.

As shown in FIG. 9, at the center front 37 of the center panel 19, by the neck opening 14, the material of the shawl 12 is pleated with pleats 32 which provides for extra material, as opposed to a flat sheet of material. This provides spaces between the material and the collar 20, which enhances flexibility and movement of the nursing cover 10 and the mother wearing and using it. This also helps provide a more spacious and flexible pocket 41 for the baby nursing below (see also FIG. 1). Again, this is opposed to a flat sheet of material used as a shawl 12 of a nursing cover 10 that does not drape well over the pocket 41 and other space underneath the cover 10.

As shown in FIGS. 1 and 2, the nursing cover 10 has a decorative weighted trim 38 along the perimeter of curved side 13 of the shawl 12. The trim 38 is preferably connected to the material of the shawl 12 by any Suitable Fasteners, for example without limitation, by stiches or other sewing materials, adhesives, or other mechanical fasteners such as buttons, zippers and hooks along seam 44. The trim 38 has weighting elements 43, including without limitation buttons, metal grommets, ball bearings, disks, washers, buttons, pins, beads and other weighted accessories. The weights 43 act as additional bottom weight for the material of the shawl 12 via the weighted trim 38. The weights 43 provide additional means and security to keep the shawl 12 and the nursing cover 10 in place, including hanging down and covering the mother and the baby. For example, if it is windy or the baby is moving around underneath, then the nursing cover 10 may otherwise lift or move to expose the mother and baby. The trim 38 may come in different varieties and colors and be fun and stylish.

As shown in FIG. 3, the nursing cover 10 also includes a collar 20. The collar 20 creates a viewing area 45 for the mother to be able to look down into pocket 41 and easily see her baby nursing. As shown in dashed lines in FIG. 3, the collar 20 preferably is comprised of a casing 30 surrounding a shell 31. The collar 20 is preferably fastened to the shawl 12. Any Suitable Fasteners may be used. For example, the collar 20 may be sewn to the shawl 12 of the nursing cover 10 along the perimeter of neck opening 14 (see also fasteners 46 in FIG. 3), or any other Suitable Fasteners may be used. The casing 30 is preferably made of fabric, such as canvas, denim, upholstery, corduroy, however other materials can be used (e.g., nylon, leather, plastic). The shell 31 is preferably made of plastic or hard rubber (including but not limited to recycled plastic products and other recycled products), but other materials can be used (e.g., aluminum or other light metals, Styrofoam, cardboard). The collar 20 can be formed in multiple sizes and dimensions, e.g., large, medium and small; variable lengths generally between 5 and 12 inches; and variable widths generally between 5 and 8 inches.

Figure 4A:
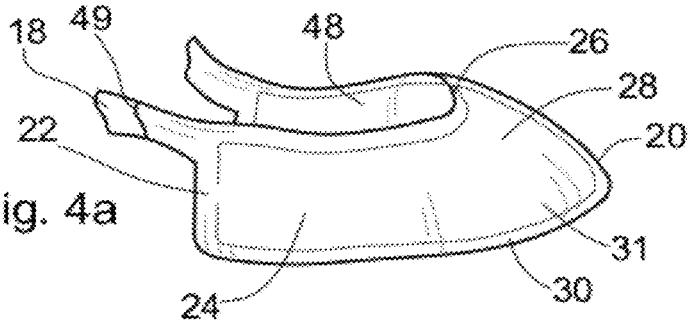
FIGS. 4*a*, 4*b* and 4*c* are side, bottom and top views of the collar of the present invention.
Figure 4B:
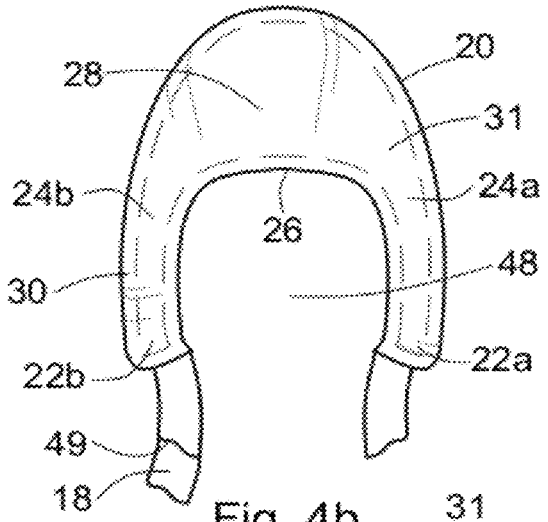
Figure 4C:
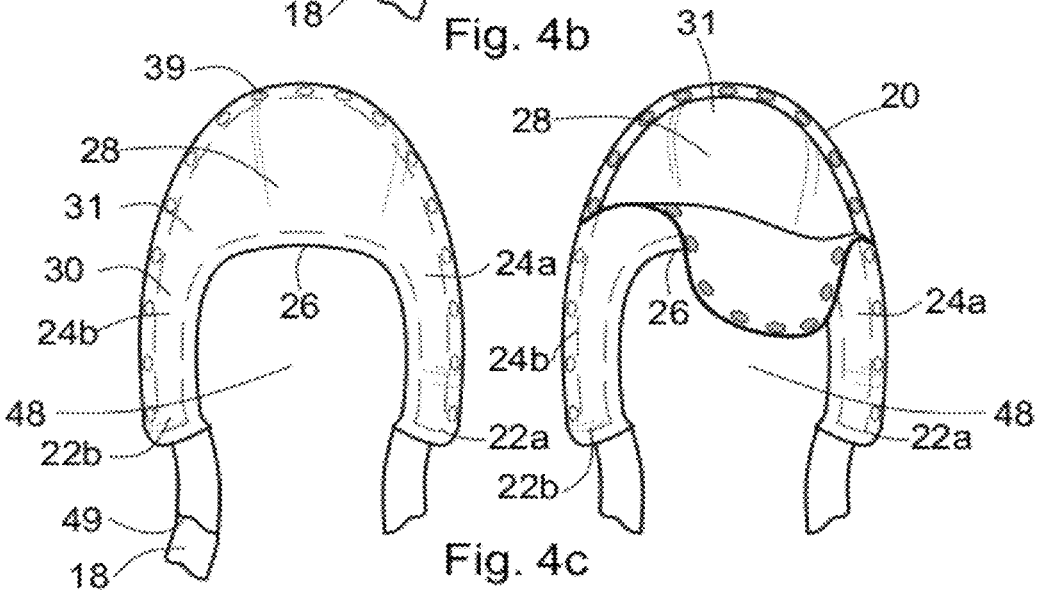
Figure 4D:
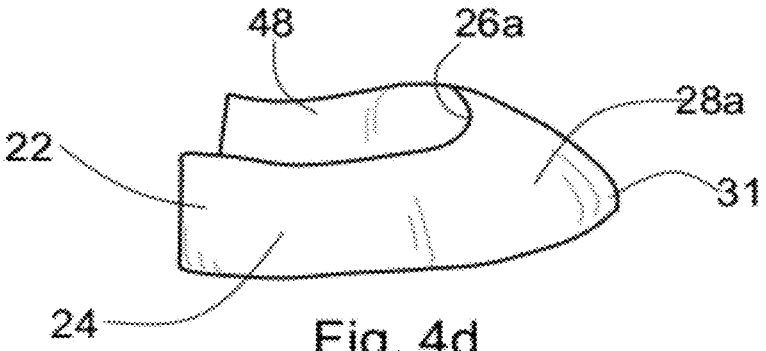
FIGS. 4*d*, 4*e* and 4*f* are side, bottom and top views of the shell of the present invention.
Figure 4E:
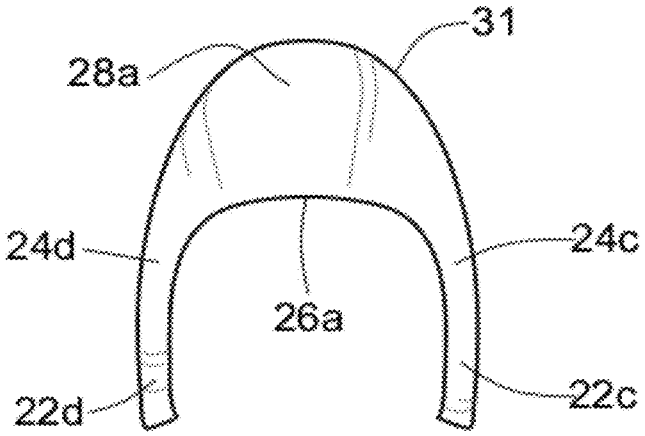
Figure 4F:
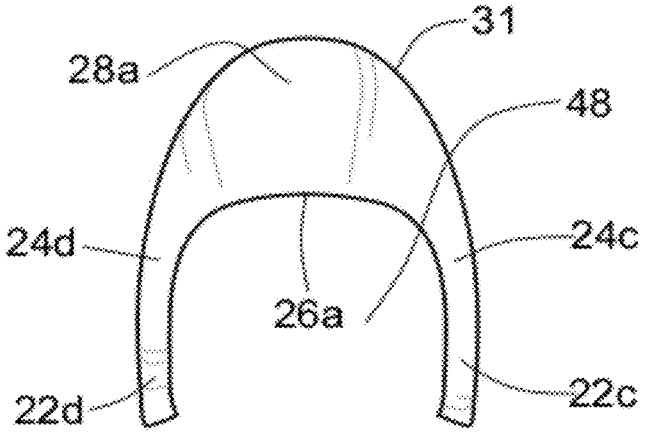
Figure 4G:
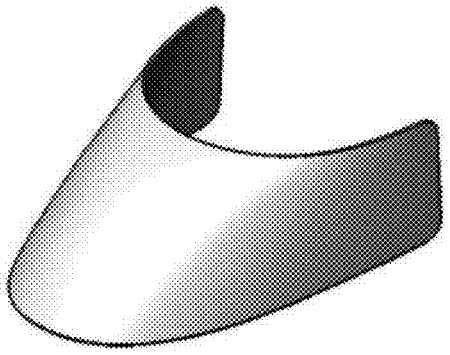
FIGS. 4*g*, 4*h*, 4*i*, and 4*j* are perspective, top, side, and back views of the shell of the present invention.
Figure 4H:
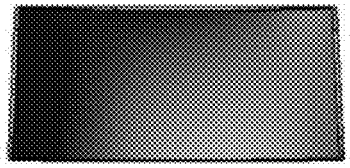
Figure 4I:
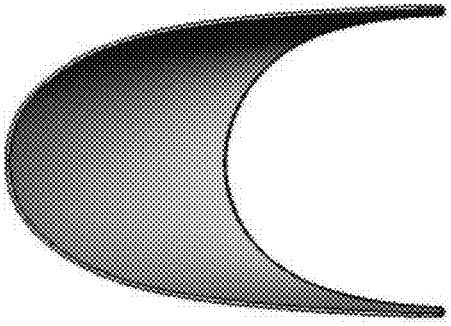
Figure 4J:
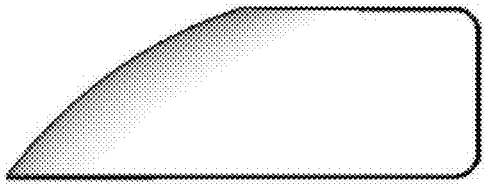

As shown in FIGS. 3 and 4*a*-4*c*, the shape and components of the collar 20, including the casing 30 and shell 31 comprising the collar 20, are similar to a visor shape (e.g., similar to a sun visor or a baseball cap visor) with extended legs 22 (22*a*, 22*b*) for resting the collar 20 against the chest plate of the mother. As such, as shown in FIGS. 4*a*-4*c* and 5, the collar 20 has legs 22 on each side 24 that, along with the bill 28, define a distance 47 of extension or tenting of the shawl 12 material from approximate the mother's chest plate to the end of bill 28 and above the nursing baby's face below (see also, distance 47 shown in FIGS. 5 and 6). The legs 22 rest upon the surface of the mother's chest to extend the sides 24, center 26 and bill 28 of the remainder of the collar 20 in a direction generally perpendicular to the vertical plane of the mother's chest at a distance 47. This creates a pocket 41 under the collar 20 and shawl 12 for the baby 42 (see also FIGS. 1 and 6). With the collar 20 of the present invention, the material is raised high up off the baby's face, allowing significant air flow for the baby 42 and eye contact for the mother and child. As shown in FIGS. 4*a-f*, the casing 30 and shell 31 similarly have corresponding legs (22*a*, 22*b* for the casing 30, 22*c*, 22*d* for the shell 31), sides (24*a*, 24*b* for the casing 30, 24*c*, 24*d* for the shell 31), center (26 for the casing 30, 26*a* for the shell 31) and a bill (28 for the casing 30, 28*a* for the shell 31). Another embodiment of the shell 31 in FIGS. 4*a-f* is shown in FIGS. 4*g-j*. As shown in particular in FIGS. 4*a*-4*c*, the smaller shell 31 fits within the casing 30, both of which comprise the collar 20. Casing 30 uses fasteners 29, including any Suitable Fasteners, to connect around shell 31, including as shown in FIG. 4*c*, snaps around the perimeter of the top of the casing 30. As such, casing 30 includes a space within which to fit shell 31, and fasteners 39 secure shell 31 within casing 30.

As shown in FIGS. 4*a-c* and 5, the shape of the bill 28 of the collar 20 is curved, which facilitates the extension and tenting of the shawl 12 material to a distance 47 and a width approximate to the width of the collar 20. The shape of the bill 28, center 26 and the sides 24 forms a curved opening 48. This opening 48 provides access to a viewing area 45 for the nursing mother so that she can easily look down at her baby in pocket 41. This allows for good eye contact with her baby which is an important factor for a mother to have when bonding with her child. As shown in FIGS. 4*a*-4*f*, the casing 30 and shell 31 comprising the collar 20 accordingly form this curved opening 48.

The collar 20 preferably includes straps 18 that go around the mother's neck. The straps 18 are connected to the collar 20 with any Suitable Fasteners. For example, see FIGS. 3 (fasteners 49) and 5. The collar 20 is also preferably connected with the shawl 12, using any Suitable Fasteners. For example, casing 30 of the collar 20 may be sewn or otherwise fastened using any Suitable Fasteners to the shawl 12 proximate the neck opening 14 (e.g., fasteners 46 in FIGS. 3, 6). Alternatively, the shell 31 may be snapped, taped or otherwise fastened using any Suitable Fasteners to the neck opening 14, as another example. The casing 30 is configured to allow the collar 20 to be removed for washing material of the shawl 12 and for washing the collar 20 (e.g., the casing 30 and/or the shell 31). For example, as shown in FIG. 3, the casing 30 of the collar 20 is fastened to the straps 18 at the ends of the legs 22 and the casing 30 is attached to the shawl 12 around the neck opening 14.

Figure 5:
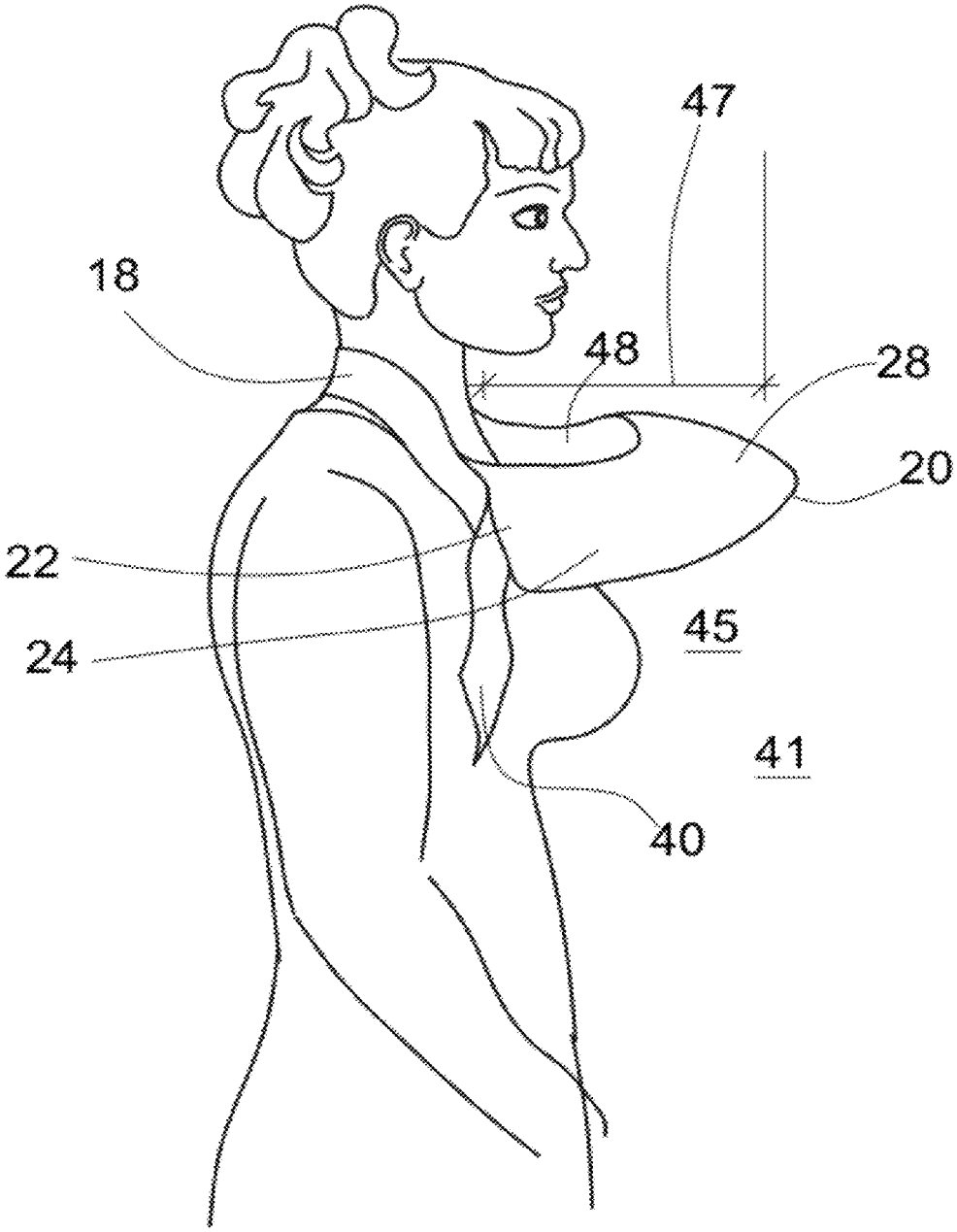
FIG. 5 is a side view of the collar and straps of the present invention.
Figure 6:
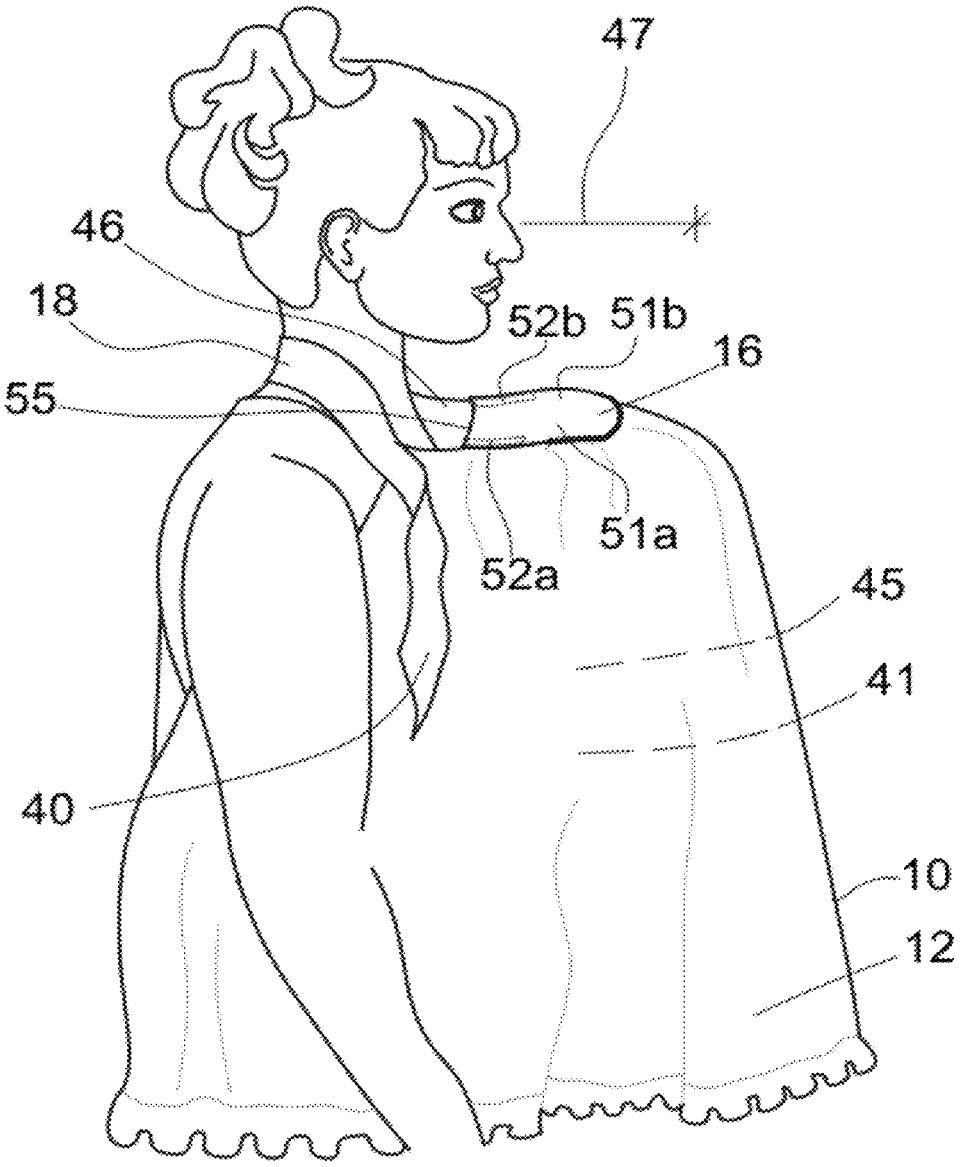
FIG. 6 is a side view of the present invention.

The straps 18 can be attached to the collar 20, explained above, or alternatively to the shawl 12. In FIGS. 2 and 9, the straps 18 are shown attached to the shawl 12. In FIG. 3, the straps 18 are attached to the casing 30, which is attached to the shawl 12 as part of collar 20. In FIGS. 4*a*-4*c* and 5, the casing 30 is attached to the straps 18 as a component of the collar 20 (e.g., see fasteners 49 (any Suitable Fasteners)). In FIG. 6, the straps 18 are attached to the casing 30, which is attached to the shawl 12 via fasteners 46 (any Suitable Fasteners).

Preferably, the straps 18 are sewn onto the casing 30 and also the material of the shawl 12, but any Suitable Fasteners could be used. As referenced above, and as shown in FIG. 5, the straps 18 wrap around the mother's neck and attach together using Suitable Fasteners (e.g., Velcro shown). This positioning holds the cover 10 around the neck and holds the collar 20 in place and balanced upon the mother's chest/collarbone area.

Figure 7:
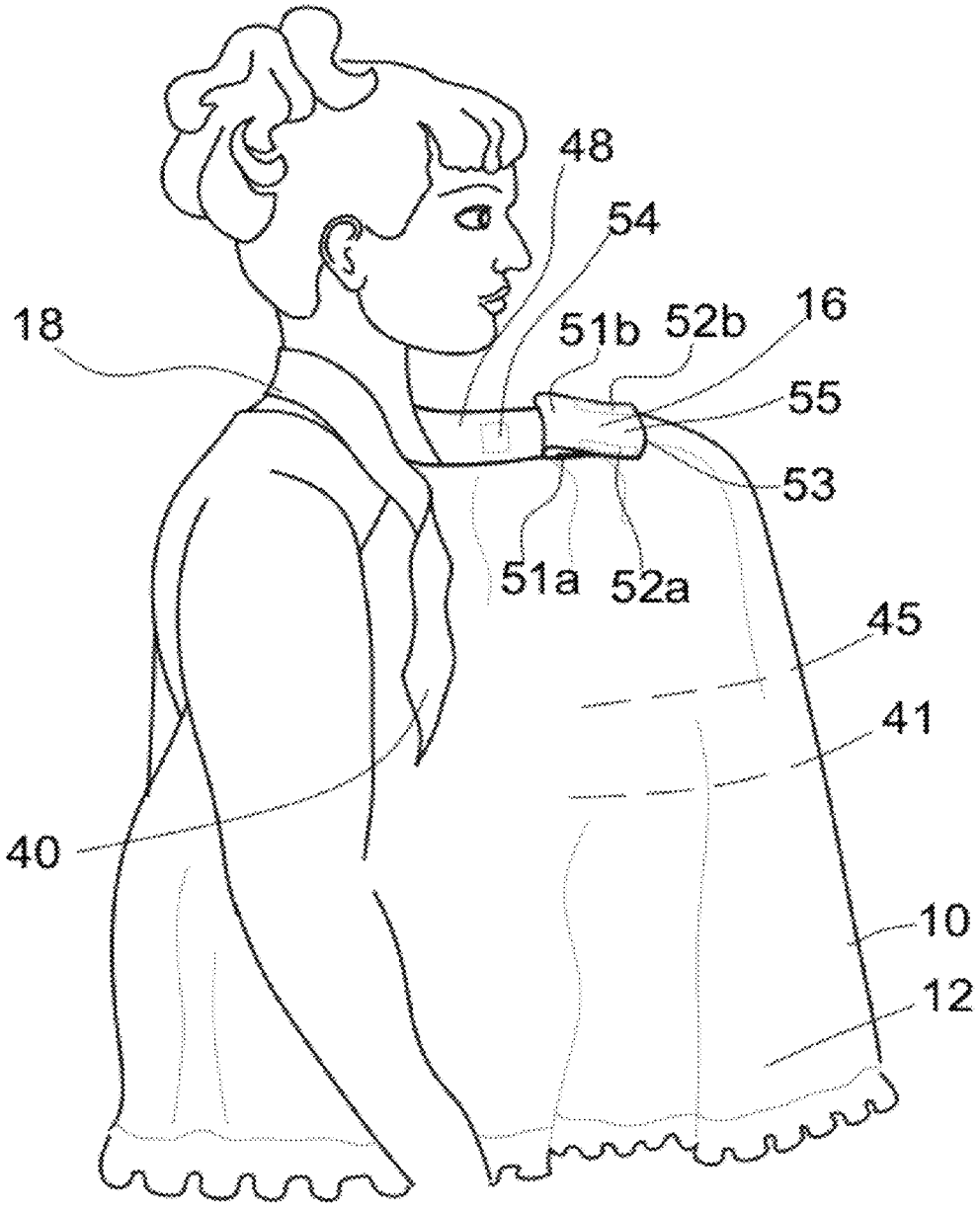
FIG. 7 is a side view of the present invention.

As shown in FIGS. 6 and 7, the nursing cover 10 also includes a pull away strap or handle 40. Preferably, this pull away strap 40 is an extension of the longer of two straps 18 (18*a* is longer). Accordingly, for the ease of putting the nursing cover 10 on around the mother's neck and taking it off, the nursing cover 10 includes this neck fastening system 50. For one strap 18*a* that goes around the neck, the strap 18*a* will be longer in length than the other strap 18*b*. Accordingly, it 18*a* will extend further beyond the connection to the other strap 18*b* and then continue to drape onto the mother's chest or back, depending on her preference. By this strap 18*a* and associated handle or pull away strap 40 being longer, the mother can locate and grab the handle 40 or tail of the strap 18*a* to put on and take off the nursing cover 10. The other shorter strap 18*b* drapes around the neck for purposes of securing the cover 10 around the mother's neck by attaching to the longer strap 18*a*.

As also shown in FIGS. 6 and 7, the shawl 12 of the nursing cover 10 also includes a flap 16. As shown, this is a small piece of material preferably sewn or otherwise connected with any Suitable Fasteners on one of its sides 51 (51*a*, 51*b* in FIG. 6) to the center front 37 of the shawl 12 proximate the neck opening 14. Material similar to the shawl 12 is preferably used. Preferably the flap 16 is rectangular, so that it has four sides 51. However, other shapes may be used (e.g., semicircle, a triangle and rectangle joined together). At least two opposite sides 51 of the flap 16 are preferably sewn or otherwise attached onto the front of the shawl 12 approximately half of the length of the sides 51*a*, 51*b* of the flap 16 using any Suitable Fasteners, and the rest of the lengths of the sides 51*a*, 51*b* of the flap 16 are attachable via easily removable Suitable Fasteners (e.g., fasteners 52*a*, 52*b*, such as snaps or Velcro). On the side 55 of the flap 16 nearest the neck opening 14, another Suitable Fastener, such as snaps, are attached to the side 55 of the flap 16 and attachable to the shawl 12 to allow the flap 16 to be opened and closed when it is folded back and forth (see FIG. 6 flap 16 closed, FIG. 7 flap 16 open). That is, the flap 16 is attachable and detachable via fasteners 52 and 53 to and from the shawl 12 to open and close the flap 16. The flap 16 preferably covers part of the opening of the collar 20. As such, the flap 16 can be opened up and down. Accordingly, the flap 16 allows the mother to open and close the curved opening 48 and access to the viewing area 45 under the nursing cover 10 for privacy and security purposes. Any Suitable Fasteners for connecting the flap 16 to the shawl 12 may be used, including without limitation, molds, zippers, buttons and other fasteners and attachment means.

In alternative embodiments, the nursing cover 10 includes an identifying mark such as the label 54 to instantly show the mother which way to place the cover 10 in the correct position. For example the label 54 may be included on the inside of the front of the shawl 12. Or, the label 54 may be on the flap 16. The flap 16 and shawl 12 also provide space for additional labels 54.

The description of the invention is merely exemplary in nature and is in no way intended to limit the invention, its application, or uses. Thus, variations that do not depart from the substance of the invention are intended to be within the scope of the invention. Such variations are not to be regarded as a departure from the spirit and scope of the invention.

What is claimed:

1. A nursing cover, comprising:

a shawl having a neck opening and a flap proximate the neck opening such that the flap forms a portion of the neck opening when the flap is in the closed position;

at least two straps connected to the shawl proximate the neck opening such that one of said at least two straps is positioned on each side of said neck opening;

a collar connected to the shawl proximate the neck opening and flap and also connected to the straps such that the flap covers at least part of the opening of the collar;

the straps secure the straps to each other and are further configured such that the straps are two different lengths, wherein the longer strap includes a handle to facilitate easy removal of said nursing cover;

the collar includes legs configured to rest on the chest beneath the collar bone of a wearer, sides and a bill wherein the collar is enclosed in a casing that connects to the shawl;

the legs extend the collar in a first direction;

the sides and bill extend the shawl in the first direction to form a pocket under the collar and shawl when the legs are configured to rest on the chest of a person wearing the nursing cover such that the pocket created does not collapse on a nursing child due to the placement of the legs and further wherein the pocket allows air flow for the nursing child;

the shawl further includes front pleats proximate the neck opening, flap and collar;

the flap opens and closes to expose space between the legs, sides and bill of the collar wherein the opening of the flap allows for eye contact between the wearer and the nursing child;

the shawl further includes side panels and fasteners at ends of the side panels that secure the ends to each other; and a weighted trim attached to the shawl.

2. The nursing cover of claim 1 wherein the shawl further has a width configured to extend around a circumference of the torso of a person wearing the nursing cover and secure around the torso when the fasteners are secured to each other.

3. The nursing cover of claim 1 wherein the shawl further has a width such that the shawl is configured to fit under the limbs of the torso of a person wearing the nursing cover.

4. The nursing cover of claim 1 further including spaces between the front pleats and the collar.

5. The nursing cover of claim 1 wherein the flap is further moveable between open and closed positions and includes connectors to secure the flap in the open and closed positions.

6. The nursing cover of claim 1 wherein the shawl is further made of light weight, non-transparent, washable, non-wrinkling material.

7. The nursing cover of claim 1 wherein the weighted trim includes multiple weights connected to the trim and decorative patterns on the trim.

8. The nursing cover of claim 1 wherein the bill of the collar is curved.

9. The nursing cover of claim 1 wherein the collar is removably connected to the shawl.

10. The nursing cover of claim 1 wherein the straps are connected to the casing of the collar.

* * * * *